US005148226A

United States Patent [19]

Setoriyama et al.

[11] Patent Number: 5,148,226

[45] Date of Patent: Sep. 15, 1992

[54] HEATING APPARATUS USING ENDLESS FILM

[75] Inventors: Takeshi Setoriyama; Akira Kuroda, both of Yokohama, Japan

[73] Assignee: Canon Kabushiki Kaisha, Tokyo, Japan

[21] Appl. No.: 825,789

[22] Filed: Jan. 21, 1992

Related U.S. Application Data

[62] Division of Ser. No. 712,573, Jun. 10, 1991, abandoned.

[30] Foreign Application Priority Data

Jun. 11, 1990 [JP] Japan ..... 1-153603
Jun. 11, 1990 [JP] Japan ..... 1-153604
Jun. 11, 1990 [JP] Japan ..... 1-153606
Jun. 11, 1990 [JP] Japan ..... 1-153609

[51] Int. Cl.[5] ..... G03G 15/20

[52] U.S. Cl. ..... 355/290; 355/284; 219/216

[58] Field of Search ..... 355/290, 282, 284, 289, 355/295; 219/216, 388; 432/59, 60

[56] References Cited

U.S. PATENT DOCUMENTS 4,780,742 10/1988 Takahashi et al. ..... 219/216 X
5,026,276 6/1991 Hirabayashi et al. ..... 355/282 X
5,027,160 6/1991 Okada et al. ..... 355/282
5,043,763 8/1991 Koh et al. ..... 355/285 X

FOREIGN PATENT DOCUMENTS 0369958 5/1990 European Pat. Off. ..... 355/290
61-90180 5/1986 Japan ..... 355/290
62-14676 1/1987 Japan ..... 355/290

*Primary Examiner*—Richard L. Moses
*Attorney, Agent, or Firm*—Fitzpatrick, Cella, Harper & Scinto

[57] ABSTRACT

An image heating apparatus includes a heater; a film movable together with a recording material; a driving rotatable member cooperative with the film to form a nip therebetween, whereby an image on a recording material being passed through the nip is heated by heat from the heater through the film; wherein the driving member has a circumferential length which increases toward longitudinal ends thereof.

29 Claims, 9 Drawing Sheets

HEATING APPARATUS USING ENDLESS FILM

This application is a division of application Ser. No. 712,573 filed Jun. 10, 1991, now abandoned.

FIELD OF THE INVENTION AND RELATED ART

The present invention relates to an image heating apparatus for fixing an image on a recording material or improving the quality of the image thereon, more particularly to an image heating apparatus wherein the recording material is heated while it is passed through the nip formed between a pressing member and a film contacted to a heater.

Conventionally, the heating apparatus for fixing an image by heat uses a heating roller which is maintained at a predetermined temperature and a pressing roller which has an elasticity and which is press-contacted to the heating roller, by which a nip is formed therebetween, through which the recording material is passed.

In such types of the apparatus, the thermal capacity of the heating roller is required to be large enough to heat the entire circumferential surface and to prevent temperature change, with the result of long waiting period required when the apparatus is started.

U.S. Ser. Nos. 206,767, (abandoned in favor of continuation application U.S. Ser. No. 668,333, filed Mar. 14, 1991), 387,970, now U.S. Pat. No. 4,954,845, 409,341, now U.S. Pat. No. 5,043,763, 416,539, now U.S. Pat. No. 4,998,121, 426,082, now U.S. Pat. No. 5,026,276, 435,247 (abandoned in favor of continuation application U.S. Ser. No. 735,739, filed Jul. 25, 1991), 430,437, 440,380 (abandoned in favor of continuation application U.S. Ser. No. 751,571, filed Aug. 22, 1991), 440,678, 444,802, 446,449, now U.S. Pat. No. 5,027,160, 496,957, 502,223, which have been assigned to the assignee of this application have proposed an image fixing apparatus, wherein the use is made with a quick response heater and thin film so that the waiting period is significantly reduced.

FIG. 13 shows an example of such an image fixing apparatus having a fixed heater and a thin film. A heat resistive film 51 in the form of an endless belt is stretched around three parallel members, more particularly a left side driving roller 52, a right side follower roller 53 and a low thermal capacity linear heater 54.

When the driving roller 52 rotates in the clockwise direction, the fixing film 51 is rotated in the clockwise direction at the predetermined speed, more particularly, at the speed which is substantially the same as the speed of conveyance of the recording sheet P (process speed) which has the unfixed toner image imparted by an unshown image forming station.

A pressing member in the form of a roller 55 is urged to the bottom surface of the heater 54 with the bottom travel of the fixing film 51 therebetween, by an unshown urging means. It rotates following the recording sheet P in the same direction as the recording sheet P.

A heater 54 extends in a direction crossing the direction of the surface movement of the fixing film 51 (the direction of the width of the fixing film 51). It is a low thermal capacity linear heater, and comprises a heater base 56, electrically energizable resistor (heat generation element) 57, a surface protection layer 58, and a temperature detecting element. The heater 54 is securedly mounted on a supporting member 61 through an insulating member.

The recording sheet P carrying the unfixed toner image Ta on its top surface, is guided by a guide 62 is introduced into a nip N between the heater 54 and the pressing roller 55, more particularly, between the fixing film 51 and the pressing roller 55. The surface having the unfixed toner image is moved at the same speed as the fixing film 51 in close contact with the fixing film 51 through the nip N between the heater 54 and the pressing roller 55.

The heater 54 is supplied with electric energy at the predetermined timing, and the generated heat is transferred to the recording sheet P which is in close contact with the fixing film 51 through the fixing film 51. The toner image is softened or fused into a softened or fused image Tb during passage thereof through the nip N.

The fixing film 51 is deflected at a relatively large curvature by the edge S of the insulating member 60. Therefore, the recording sheet P being conveyed together with fixing film 51 is separated by the curvature change from the fixing film 51 at the edge S, and is discharged. By the time when it reaches the discharging station, the toner is sufficiently solidified and fixed on the recording sheet P as the fixed image Tc.

Such an apparatus requires a particular driving roller 52 to drive the film. It would be considered to drive the film by driving the pressing roller which constitutes a nip in cooperation with the heater 54 with the film therebetween. By doing so, the necessity for the roller is substantially exclusively for driving the film. If, however, this is done, the film may be creased. In addition, the possible slip between the pressing roller and the film and between the recording material and the film may cause disturbance of the toner image on the recording material.

SUMMARY OF THE INVENTION

Accordingly, it is a principal object of the present invention to provide an image heating apparatus wherein the production of crease in the film is prevented. It is another object of the present invention to provide an image heating apparatus, wherein the recording material is prevented from slipping.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 12:
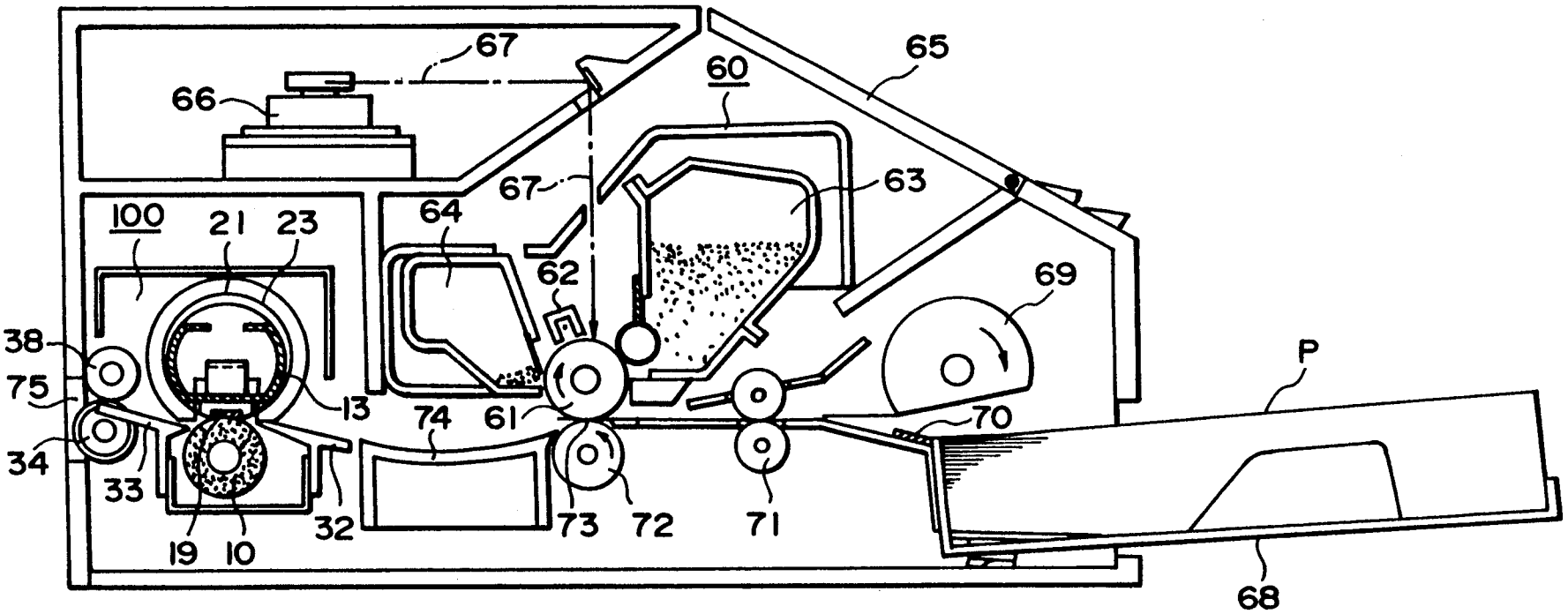
FIG. 12 is a sectional view of an image forming apparatus using the image fixing apparatus according to an embodiment of the present invention.

Referring to FIG. 12, the description will be made as to the image forming apparatus using the image heating apparatus as an image fixing means. The image forming apparatus shown is a laser beam printer, which comprises a process cartridge 60 containing an electrophotographic photosensitive member in the form of a rotatable drum 61, a charger 62, a developing device and a cleaning device (four process means). The process cartridge is detachably mountable when the apparatus is opened at the portion 65.

In operation, the drum 61 rotates in the direction of the arrow (clockwise direction) upon generation of image formation start signal. The surface of the drum 61 is uniformly charged by the charger 62 to a predetermined potential of a predetermined polarity, and is then exposed to a scanning laser beam 67 which is produced from a laser scanner 66 and modulated in accordance with the image information to be recorded (time series digital pixel signals), so that an electrostatic latent image is formed on the drum 61 in accordance with the desired image information. The latent image is developed into a toner image.

On the other hand, the sheet P is fed out of a sheet cassette 68 by cooperation of a sheet pick-up roller and a separation pad 70 one by one, and is fed, in timed relation with the toner image on the drum 61 by a pair of registration rollers, to an image transfer station having an image transfer roller 73 press-contacted to the drum 61 to form an image transfer nip, where the image is transferred from the drum 61 onto the sheet P.

The sheet P now having the transferred image, is separated from the drum 61, and is supplied into the fixing device 100, where the toner image is fixed by heat. The sheet P is finally discharged through an outlet 75 as a print.

The surface of the drum 61 from which the image has been transferred at the transfer station 73, is cleaned by the cleaning means 64, so that the contaminations such as the residual toner are removed. Then, the drum 61 is prepared for the next image forming operation.

Figure 1:
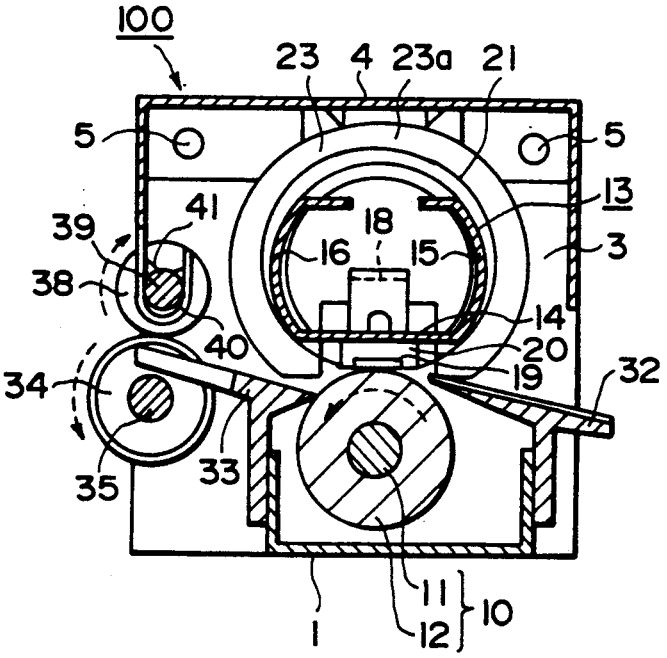
FIG. 1 is a sectional view of an image fixing apparatus according to an embodiment of the present invention.
Figure 3:
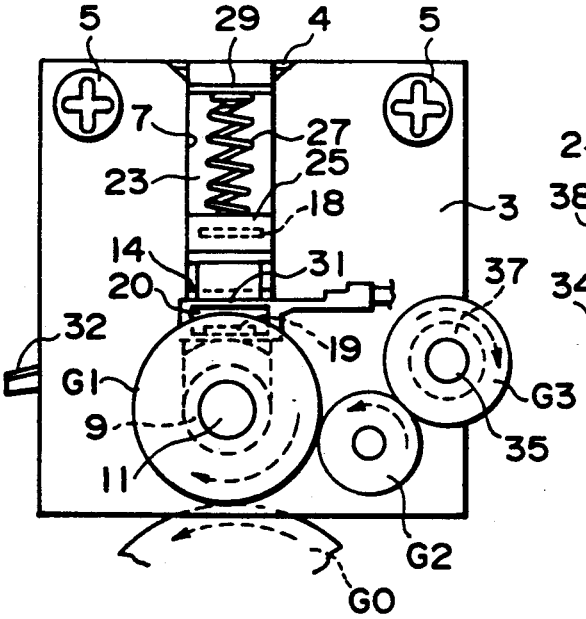
FIG. 3 is a right side view of the image fixing apparatus.
Figure 4:
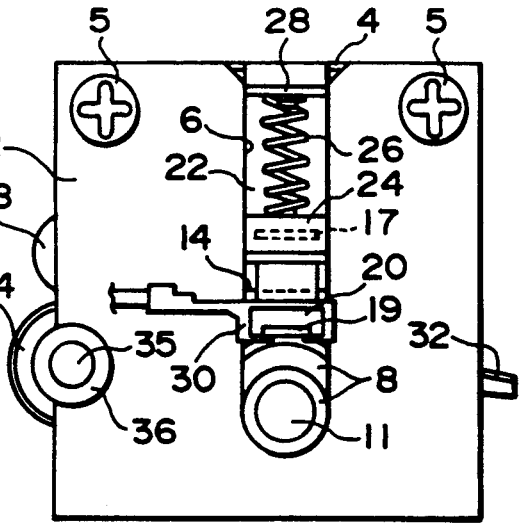
FIG. 4 is a left side view of the image fixing apparatus.
Figure 2:
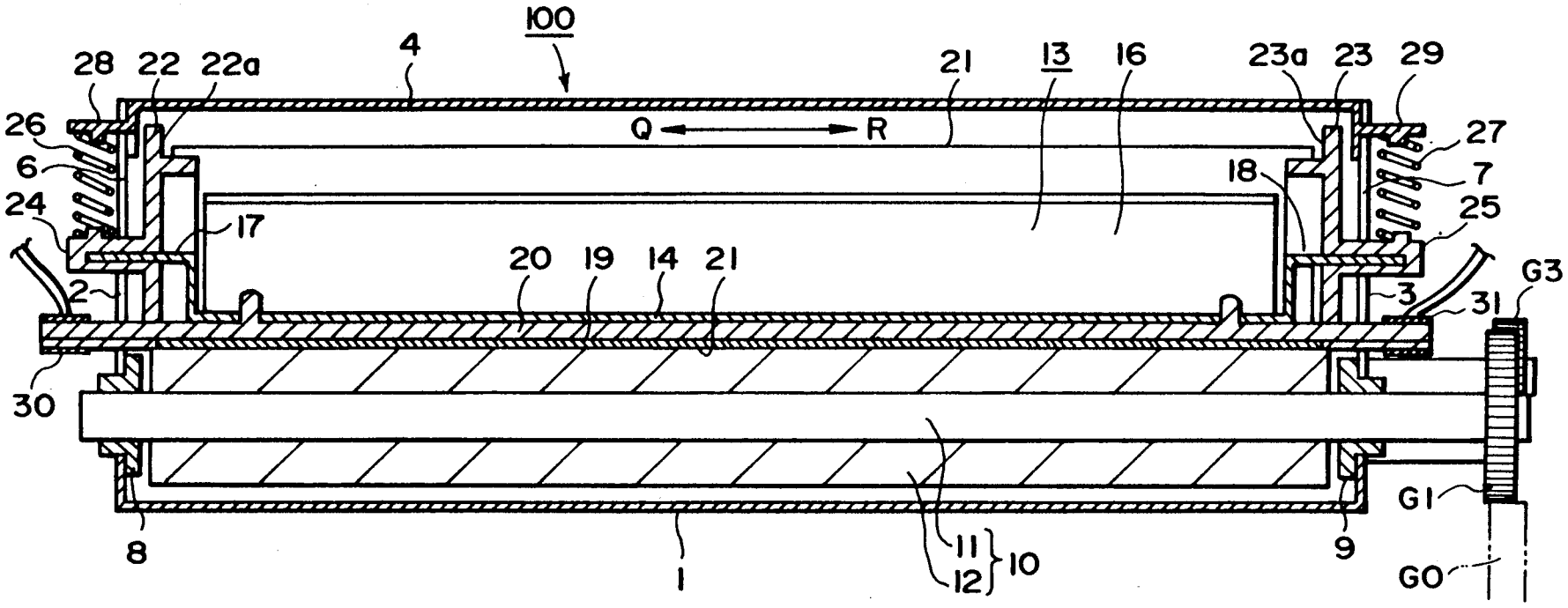
FIG. 2 is a longitudinal sectional view of the image fixing apparatus.
Figure 5:
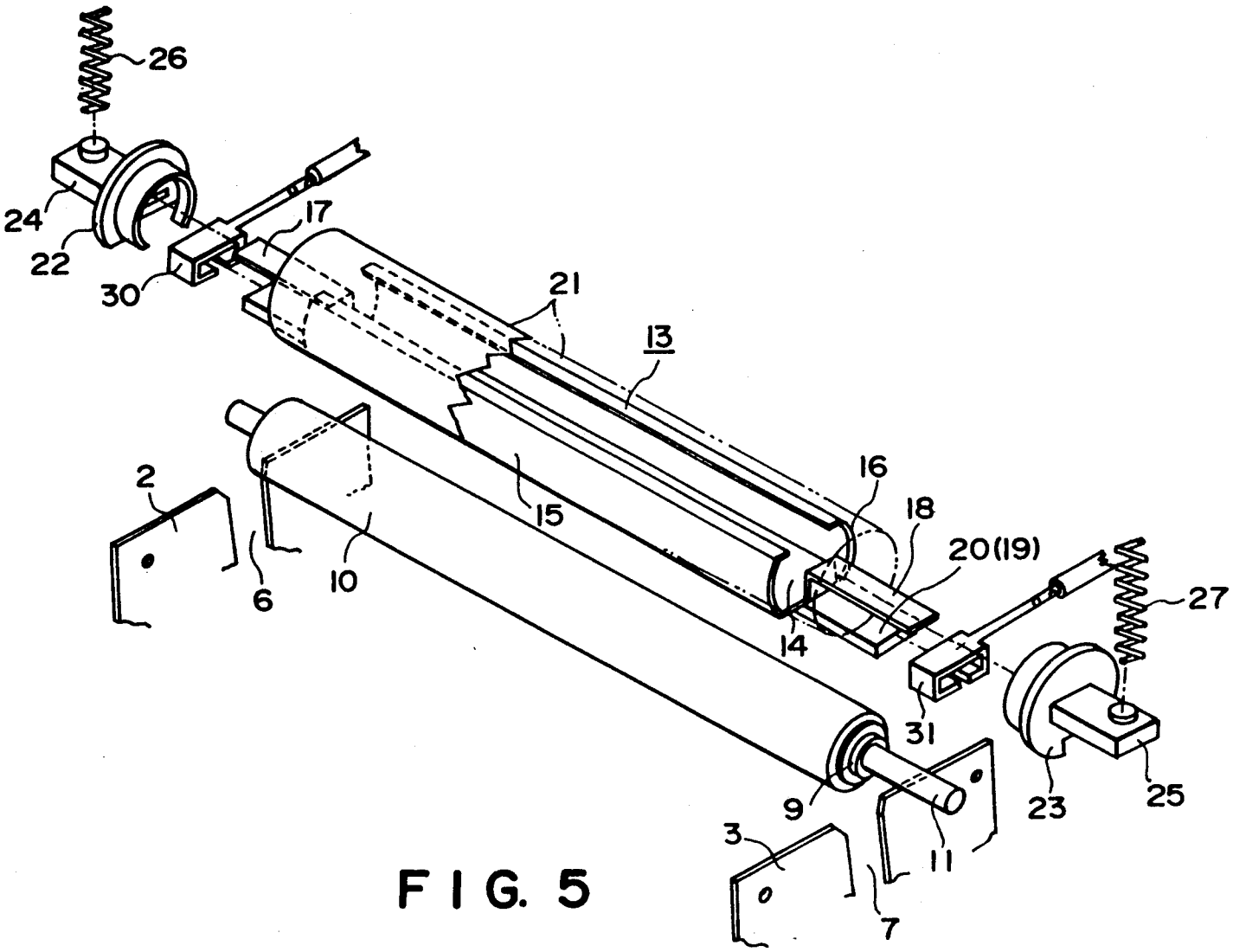
FIG. 5 is a perspective view of the major part of the image fixing apparatus.

Referring to FIGS. 1-5, the description will be made as to the fixing apparatus according to the present invention. FIG. 1 is a sectional view of a fixing device 100; FIG. 2 is a longitudinal sectional view; FIGS. 3 and 4 are a right sectional view and a left sectional view, respectively: and FIG. 5 is a perspective view of the major part. A frame 1 (bottom plate) is made of an elongated plate and has a channel-like cross section. Left and right plates 2 and 3 are integrally mounted on the frame 1 at the right and left ends. A top cover 4 is fixed to the top ends of the side plates 2 and 3 by screws 5. The top cover 4 can be removed by loosening the screws 5.

Vertically elongated slots 6 and 7 are formed in the side plates 2 and 3 respectively, at the symmetrical positions. A pair of bearings 8 and 9 are fixedly mounted to the bottom of the slots 6 and 7.

A film back-up or pressing roller 10 is cooperative with a heater, which will be described hereinafter, to form a nip with a film therebetween. The pressing roller 10 comprises a central shaft 11 and a roller portion 12 on the shaft 11 which is made of a material having good parting property, such as silicone rubber. The left and right ends of the central shaft 11 are rotatably supported by the bearings 8 and 9. A laterally extended stay 13 is elongated and made out of a plate, and functions both as internal guide for the a film 21 and as a supporting and reinforcing member for the heater 19 and the heat insulating member 20, which will be described hereinafter.

The stay 13 has a flat bottom portion 14, front and rear walls 15 and 16 extended vertically from respective longitudinal ends of the bottom portion 14 and arcuated outwardly, and a pair of horizontal lags 17 and 18 extended outwardly from left and right ends, respectively.

Figure 6:
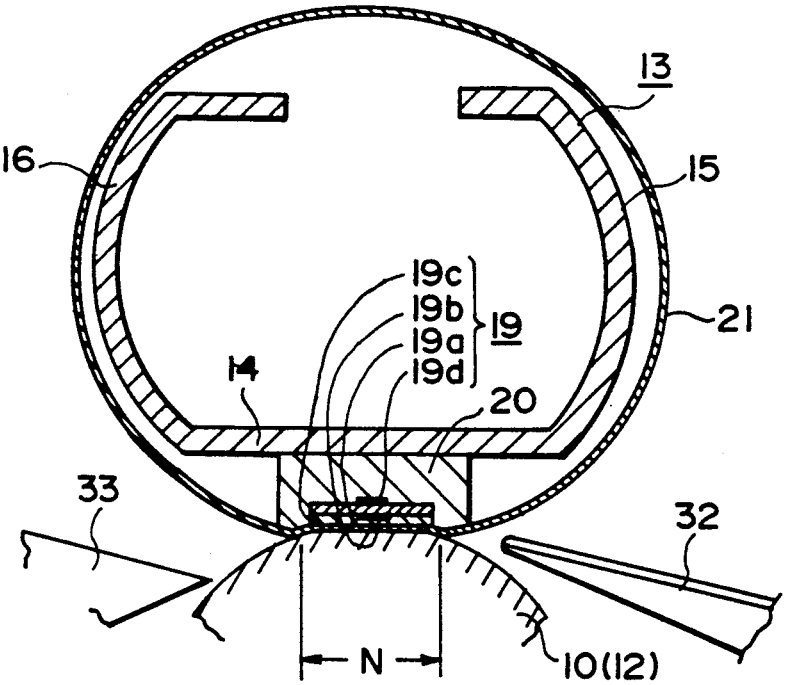
FIG. 6 is an enlarged sectional view illustrating the film when it is not driven.

As shown in FIG. 6 A low thermal capacity linear heater 19 has an elongated form, and is mounted on the elongated insulating member 20, and the insulating member 20 is integrally mounted on the bottom surface of the bottom portion 14 of the stay 13 with the linear heater 19 side facing down in parallel therewith.

A heat resistive film 21 is in the form of an endless belt, and is stretched around the stay 13 including the linear heater 19 and the insulating member 20. An internal circumferential length of the heat resistive film 21 is longer by, for example, 3 mm than the external circumferential length of the stay 13 including the linear heater 19 and the insulating member 20. Therefore, the heat resistive film 21 is loosely extended around the stay 13 including the linear heater 19 and the insulating member 20.

Figure 8:
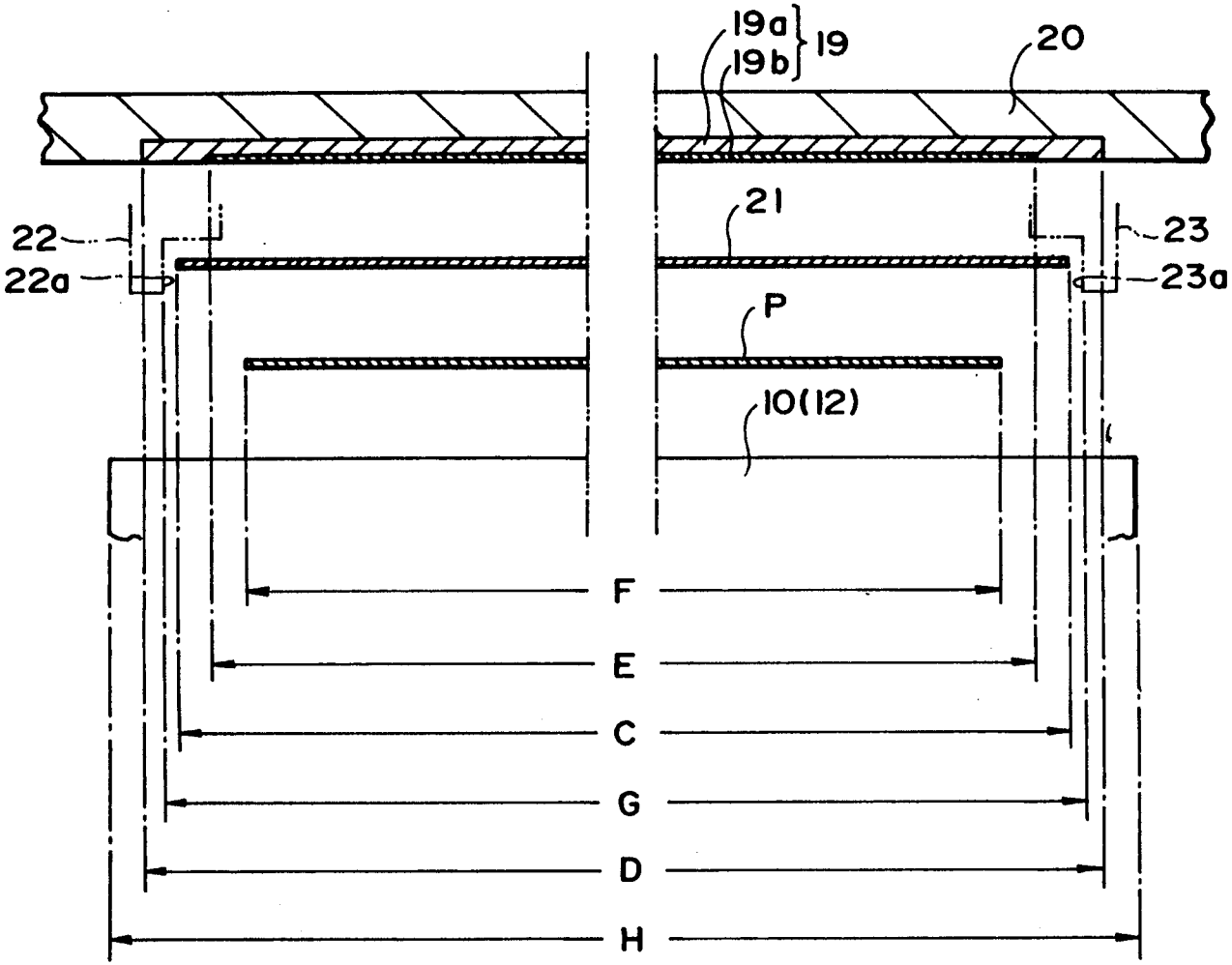
FIG. 8 illustrates dimensional relations among the constituent elements.

A pair of right and left flanges 22 and 23 function to limit the lateral ends of the heat resistive film 21, and are securedly mounted on the horizontal lags 17 and 18 of the stay 13, after the the heat resistive film 21 is mounted on the stay 13 including the linear heater 19 and the insulating member 20. As will be described hereinafter, the distance G between the internal seats 22*a* and 23*a* of the flanges 22 and 23 (FIG. 8) is slightly larger than the width C of the heat resistive film 21 (FIG. 8).

Horizontal lags 24 and 25 are extended outwardly from the outer surface of the flanges 22 and 23. The outward lags 17 and 18 of the stay 13 described herein before are fitted in holes of the horizontal lags 24 and 25 of the flanges 22 and 23, so that the left and right the flanges 22 and 23 are securedly mounted.

In assembling the apparatus, when the top cover 4 is not mounted on the side plates 2 and 3, the bearings 8 and 9 mounted on the central shaft 11 of the pressing roller 10 at the longitudinal ends are inserted into the elongated slots 6 and 7 from the top until the bearings 8 and 9 are seated on the bottom of the slots 6 and 7, by which the pressing roller 10 is set between the side plates 2 and 3 (falling set).

Then, a sub-assembly constituted by the stay 13, the linear heater 19, the insulating member 20, the heat resistive film 21, the flanges 22 and 23, is set between the side plates 2 and 3. While the heater side is facing down, the left and right lags 24 and 25 of the flanges 22 and 23 and the lags 24 and 25 are inserted into the slots 6 and 7 of the side plates 2 and 3, until the faced-down heater 19 is seated on the top surface of the pressing roller 10 with the heat resistive film 21 therebetween (falling set).

Coil springs 26 and 27 are positioned around projections formed on the lags 24 and 25 of the flanges 22 and 23, respectively. The top cover 4 is set so that the lags 28 and 29 compress the coil springs 26 and 27 between the lags 24 and 28, and between the lags 25 and 29. Then, the top cover 4 is secured between the left and right side plates 2 and 3 by screws.

The coil springs 26 and 27 urges the stay 13, the linear heater 19, the insulating member 20, the heat resistive film 21 and the flanges 22 and 23 downward, so that the linear heater 19 and the pressing roller 10 are pressed to each other with the heat resistive film 21 therebetween at a uniform pressure, for example, at the total pressure of 4–7 Kg.

Power supply contacts 30 and 31, mounted on the left and right ends of the insulating member 20, penetrate outward though the respective side plates 2 and 3, and function to supply power to the linear heater 19.

A guide 32 functions to guide the material to be heated by the heater and is mounted on the front wall of the frame 1. In this embodiment, the material is a recording material or sheet P (FIG. 7) carrying a visualized or toner image Ta. The sheet P is introduced along the guide 32 into the nip N (fixing nip) between the linear heater 19 and the pressing roller 10, more particularly, between the heat resistive film 21 and the pressing roller 10.

A separation or outlet guide 33 is mounted on the rear wall of the frame 1, and functions to guide the sheet P into a nip between a lower discharging roller 34 and a pinch roller 38.

The left and right ends of the discharging roller 34 are rotatably supported by bearings 36 and 37 on the side plates 2 and 3. The roller 38 has a shaft 39 which is received by hook portion 40 formed by bending a part Of the rear wall Of the top cover 4, so that it is contacted to the top surface of the discharging roller 34 by the weight of the roller 38 and a spring 41. Thus, the 38 rotates following pinch roller rotation of the discharging roller 34.

A first gear G1 is fixed on the right end of the central shaft 11 extending through the right side wall 3. A third gear G3 is fixed on the right end of extending through the right side wall 3. A second gear G2 is a relaying gear which is rotatably supported on the outer surface of the right side wall, and the second gear G2 is meshed with the first gear G1 and the third gear G3.

The first gear G1 is driven by a driving gear G0 coupled with an unshown driving source, upon which the pressing roller 10 is rotated counterclockwisely in FIG. 1. Then, the rotation of the first gear G1 is transmitted through the second gear G2 to the third gear G3, so that the discharging roller 34 is rotated counterclockwisely.

The description will be made as to the fixing operation of the heating apparatus according to this embodiment. As shown in FIG. 6, the heat resistive film 21 in the form of an endless belt, is tension-free except for the portion sandwiched in the nip formed between the linear heater 19 and the pressing roller 10, when the film 21 is not driven.

Figure 7:
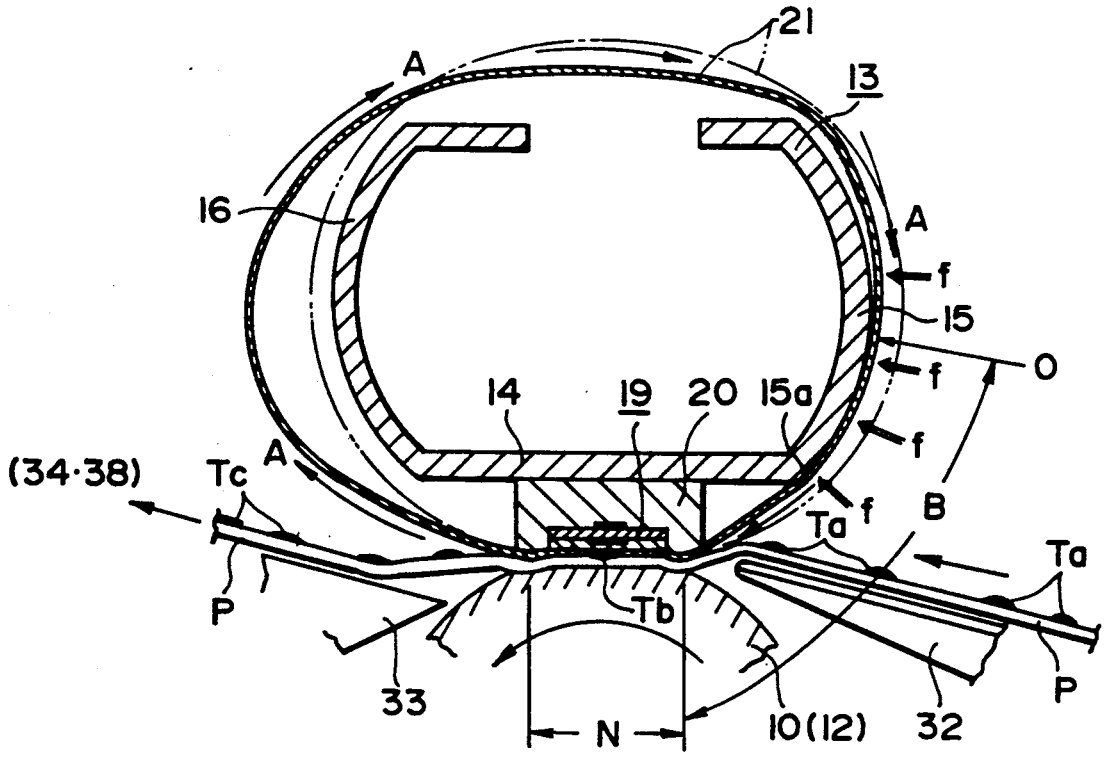
FIG. 7 is an enlarged sectional view illustrating the film when it is driven.

The driving force is transmitted from the driving source through the first gear so that the pressing roller 10 is rotated at a predetermined peripheral speed in the counterclockwise direction in FIG. 7. Then, in the nip N, the heat resistive film 21 frictionally rotates with the pressing roller 10, and the heat resistive film 21 rotates in the clockwise direction at the same peripheral speed as that of the pressing roller 10, while the inside surface of the heat resistive film 21 is in contact with the linear heater 19 surface.

In such a driving of the heat resistive film 21, pulling force f is applied to the portion of the heat resistive film 21 upstream of the nip N with respect to the rotational direction of the heat resistive film 21. Therefore, as shown in FIG. 7 by the solid lines, when the heat resistive film 21 is rotated, the inside surface of the film 21 is kept in contact with the film guiding surface upstream of the nip, more particularly, in contact with about the bottom half of the arcuated front plate 15 of the stay 13 which functions as the front guide for the heat resistive film 21.

As a result, the portion B of the heat resistive film 21 which is between the contact starting position between the front plate 15 and the heat resistive film 21 and the nip portion of the heat resistive film 21, receives the tension. Therefore, the portion B and the nip portion of the heat resistive film 21 is prevented from being creased.

While the film is being driven in this manner, and while the heater is supplied with electric power, the sheet P carrying the unfixed toner image Ta is guided by the guide 32, and is introduced into the nip N between the heat resistive film 21 and the pressing roller 10 with the image carrying surface face-up. The sheet P is passed through the nip N with the heat resistive film 21 closely contacted thereto. During the passage of the sheet P, the heat is applied to the toner image Ta from the linear heater 19 in contact with the inner surface of the film, by which the toner image is fused into a softened or fused toner image therebetween.

The sheet P is separated from the heat resistive film 21 surface while the toner temperature is higher than the glass transition point, and is guided by the outlet guide 33 to the nip between the discharging roller 34 and the roller 38, and is discharged to the outside of the apparatus. By the time when the sheet P reaches to the discharging roller 34, the softened or fused toner is cooled or solidified into a solidified image Tc.

As described hereinbefore, the sheet P in the nip N is always in close contact with that part of the film which is free from the crease because of the tension applied thereto, and is moved together with the film 21. Therefore, non-uniform heating, non-uniform fixing or the like can be prevented.

The heat resistive film 21 experiences the tension only at a part thereof (N, or N and B) during driving or non-driving thereof. More particularly, when the heat resistive film 21 is not driven, as shown in FIG. 6, the heat resistive film 21 is tension free at almost all of the portions thereof, except for the nip portion; and when the heat resistive film 21 is driven, almost all of the portions except for the partition N and portion B. In addition, the heat resistive film 21 may have a shorter circumferential length. For these reasons, the torque required for driving the film may be small, and the structure of the film and the driving mechanism are simplified, and the size and the cost thereof are reduced.

Since the tension is applied only to part of the heat resistive film 21 irrespective of driving and non-driving thereof, the lateral shifting force to the heat resistive film 21, if any, in the direction, for example, direction Q or R in FIG. 2, is small.

Therefore, even if the heat resistive film 21 is laterally shifted in the direction Q or R to such an extent that the left or right edge of the heat resistive film 21 abuts the inside surface of the jaw 22a of the left flange 22 or the right flange 23, the lateral shifting force is so small that the rigidity of the heat resistive film 21 overcomes the lateral shifting force, and therefore, the edges of the heat resistive film 21 are not yielded or damaged. The lateral shift preventing means may be the simple flanges. This is also contributable to the simplification of the structure of the apparatus and the reduction of the size and the cost of the apparatus.

As for the alternative for the lateral shift preventing means, the heat resistive film 21 may be provided with ribs at the lateral edges which are confined against the lateral shift.

The reduction of the lateral shifting force as described above, makes it possible to reduce the rigidity of the heat resistive film 21, so that the thickness of the film and therefore the thermal capacity of the film can be reduced to further improve the quick starting of the apparatus.

The description will be made as to the film. For the purpose of lower thermal capacity in view of the quick start of the apparatus, the total thickness of the film is not less than 100 microns, particularly, 40 microns, and not more than 20 microns. It may be a single layer or multiple layer film having good heat resistivity, parting property, mechanical strength resistivity or the like.

It may be a single layer film of a heat resistive resin such as polyimide, polyether imide (PEI), PES (polyether sulfon) PFA (tetrafluoroethylene perfluoroalkylvinyl ether copolymer resin), polyetherether ketone (PEEK), polyparabamic acid (PPA), or a multi-layer film comprising a film of 20 micron thickness and a coating layer of 10 micron thickness having good parting property at the image contactable side of the film, the coating layer being made of fluorinated resin or silicone resin such as PTFE (tetrafluoroethylene resin), PFA or FEP added with conductive material, such as carbon black, graphite, conductive whisker.

The description will be made as to the linear quick response heater 19 and the insulating member 20 for insulatively supporting the linear heater 19. Similarly to the heater 54 shown in FIG. 13, the heater comprises a heater base plate 19a (FIG. 6), electric heat generating element 19b, a surface protection layer 19c and temperature sensing element 19d. The heater base plate 19a is made of the material having good heat resistivity, heat insulation sufficiently low thermal capacity and sufficiently high heat conductivity, for example, alumina plate having a thickness of 1 mm, width of 10 mm and length of 240 mm.

The heater 19 extends on the bottom surface of the heater base plate 19a, that is, the surface contactable to the heat resistive film 21, along the longitudinal center line thereof, and is provided by applying, in the form of a line or stripe of the width of approximately 1-3 mm and the thickness of approximately 10 microns, Ag/Pd (silver paradium), $Ta_2N$, $RuO_2$ or another electric resistance material by screen printing. It is then coated with a surface protection layer 19c of heat resistive glass having a thickness of approximately 10 microns. An example of the temperature sensing element 19d is a low thermal capacity temperature sensor provided by applying Pt film on the top surface of the heater base plate 19a (the side opposite from the heater 19b side) adjacent the center thereof. As an alternative, a low thermal capacity thermister is usable.

In the linear heater 19 in this embodiment, the power is supplied to the linear or stripe heater 19b at predetermined timing from the image formation signal generation so that the heat is generated over the entire length of the heater.

The power source is AC 100 V. The power supply is controlled by an unshown power supply control circuit in response to an output of the protection layer 19c by changing the phase angle of the power supply.

Upon power supply to the heater base plate 19a, the surface of the linear heater 19 is instantaneously heated up to a fixing temperature, for example, 140°-200° C., because the heater base plate 19a, the heat generating element 19b and the protection layer 19c have small thermal capacity.

Since the thermal capacity of the heat resistive film 21 contacted to the linear heater 19 is low, the heat energy from the linear 19 is efficiently transmitted to the sheet P through the heat resistive film 21.

The temperature of the heat resistive film 21 is quickly heated up to the level sufficient in consideration of the fusing point of the toner or the fixable temperature for the sheet P. Therefore, the quick start of the apparatus is possible so that the necessity for the standby warming which is the warming of the linear heater 19 in preparation of coming operation instructions. Accordingly, the energy consumption can be saved, and the undesirable inside temperature rise can be avoided.

The insulating member 20 is effective to direct the thermal energy generated by the heat generating resistance element to the nip. It is made of insulating and heat resistive material such as PPS (polyphenylenesulfide PAI(polyimideamide), PI polyimide), olyetheretherketone) or liquid crystal polymer or the like.

The description will be made as to the width C of the film and the length D of the nip. As shown in FIG. 8, in order to prevent damage of the lateral ends of the film, it is preferable that $C<D$ is satisfied, where C is the width of the heat resistive film 21, and D is the length of the nip N formed by the linear heater 19 and the pressing roller 10 with the film 21 therebetween.

If $C \geqq D$, the film feeding force in the area within the nip length D is significantly different from that outside the area, since in the former area, the film is driven while the inside surface thereof is in sliding contact with the linear heater 19, whereas in the latter area, the film is driven while the inside surface thereof is in sliding contact with the surface of the the insulating member 20 made of different material. The difference is so significant that the heat resistive films 21 may be creased or folded adjacent the lateral end portions.

By satisfying $C<D$, it is assured that the entire width of the inside surface of the heat resistive film 21 is in contact with the length D of the surface of the linear heater 19, while the heat resistive film 21 is driven. Therefore, the film feeding force is uniform over the entire width of the area C, whereby film trouble can be avoided.

The pressing roller 10 used in this embodiment is made of material having sufficient elasticity, such as silicone rubber. This means that the surface frictional coefficient thereof changes with temperature. Therefore, the frictional coefficient between the pressing roller 10 and the heat resistive film 21 within the length E of the heat generating element 19a and that between the pressing roller and the film outside the length E, are different.

In this embodiment, the dimensional relation is such that the E<C<D. By doing so, the difference between the length E and the width C can be reduced, and therefore, the difference between the frictional coefficients between the pressing roller 10 and the heat resistive film 21 in the area within the length E and the outside thereof, can be reduced, so that the difference in the feeding can be reduced.

Accordingly, the heat resistive film 21 can be stably fed by the pressing roller 10 without damage of the end portions of the heat resistive film 21.

Film stopping surfaces 22*a* and 23*a* of the flanges 22 and 23 are disposed within the length of the pressing roller 10. Therefore, the ends of the heat resistive film 21 are protected even if the film is laterally shifted.

Figure 9A:
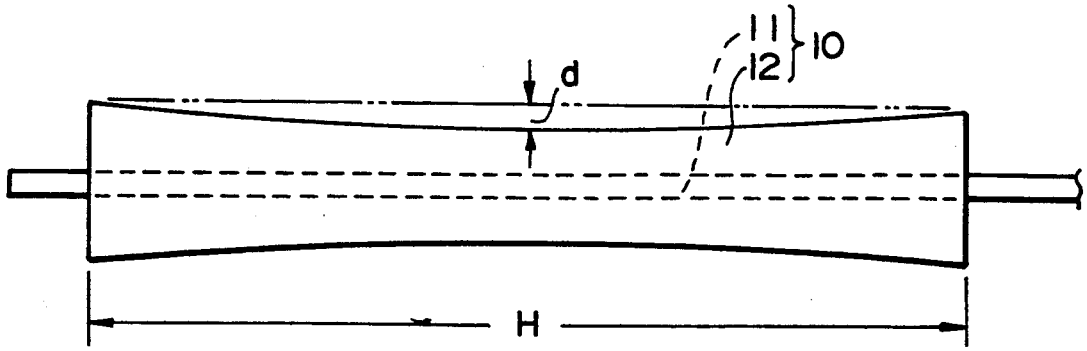
FIGS. 9A and 9B are top plan views of the pressing rollers, the configuration of which is somewhat exaggerated.
Figure 9B:
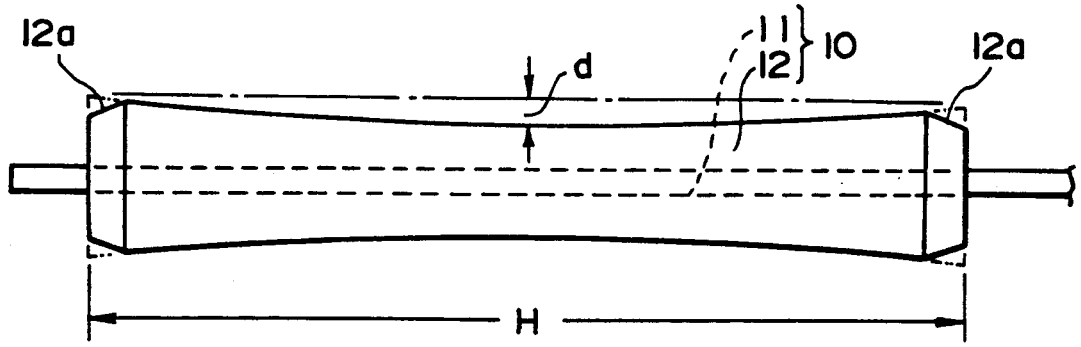

The description will be made as to the pressing roller 10 which also functions to drive the film. The pressing roller 10 is cooperative with the linear heater 19 to form the nip N with the heat resistive film 21 therein and functions to drive the heat resistive film 21. It is made of elastic rubber having good parting property such as silicone rubber. It is not a straight roller, rather a reversely crowned roller, as shown in FIGS. 9A or 9B, in which the reverse crowning is somewhat exaggerated. The longitudinal end portions may be cut out, as indicated by reference 12*a*. The degree of the reverse crowning is 100–200 microns when the effective length H of the pressing roller 10 is 230 mm, for example.

If the pressing roller 10 is a straight roller, the pressure distribution between the pressing roller 10 and the heat resistive film 21 in the nip N over the width of the film is not uniform, more particularly, the pressure is higher in the central portion than in the marginal portions, as the case may be, depending on the unavoidable manufacturing tolerances. If this occurs, the feeding force to the film is larger in the central area than the marginal areas, and the film tends to deform toward the central portions which receive larger feeding force. This means that the marginal portions are deformed to the central portion, with the possible result of production of a film crease and of a crease of the sheet P introduced into the nip with the film.

However, in the present embodiment, the pressing roller 10 is reversely crowned, that is, the circumferential length is continuously and substantially monotonously increased from the longitudinal center to the longitudinal ends, and therefore, the pressure distribution is such that the pressure is higher in the marginal areas than in the central areas, so that the forces are applied to stretch the film in the laterally outward directions, and therefore, the production of a crease can be prevented in the heat resistive film 21 and the sheet P.

The pressing roller 10 of this embodiment functions to press-contact the heat resistive film 21 to the linear heater 19, to drive the film at the predetermined speed, and to press-contact the sheet P to the surface of the heat resistive film 21 and drive the sheet P at the predetermined speed when the sheet P is introduced in the nip N. By doing so, the lateral shifting force is reduced, and the positional accuracy of the pressing roller 10 and the gears for driving the pressing roller 10, can be improved.

When the pressing function for urging the heat resistive film 21 or the heat resistive film 21 and the sheet P, and the moving function for moving the heat resistive film 21, are performed by a pressing rotatable member (the necessary pressure is provided by pressing the rotatable member), and a film driving rotatable member, respectively, then the lateral ends of the heat resistive film 21 are liable to be creased or folded, if the alignment between the linear heater 19 and the film driving mechanism, are disturbed. When a pressing member functioning also as the film driving member is urged by springs or the like to urge the film to the linear heater 19, the position of the rotatable member or the gears for driving the rotatable member is not easily determined.

In this embodiment, the pressure required for the fixing is applied to the linear heater 19; the pressing roller 10 functions to urge the sheet p to the heat resistive film 21; and the pressing roller 10 also functions to drive the heat resistive film 21 and the sheet P. Therefore, the advantageous effects described herein-before can be provided. In addition, the structure of the apparatus can be simplified, and low cost reliable apparatus can be provided.

Figure 10:
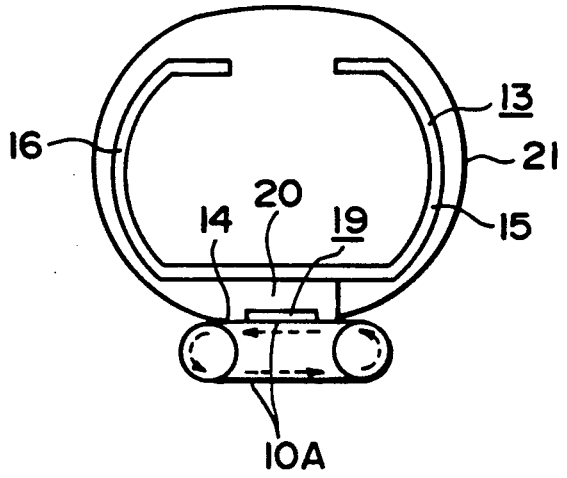
FIG. 10 is a sectional view of the image fixing apparatus according to a second embodiment of the present invention.

The pressing roller 10 may be in the form of an endless belt 10A, as shown in FIG. 10.

Figure 13:
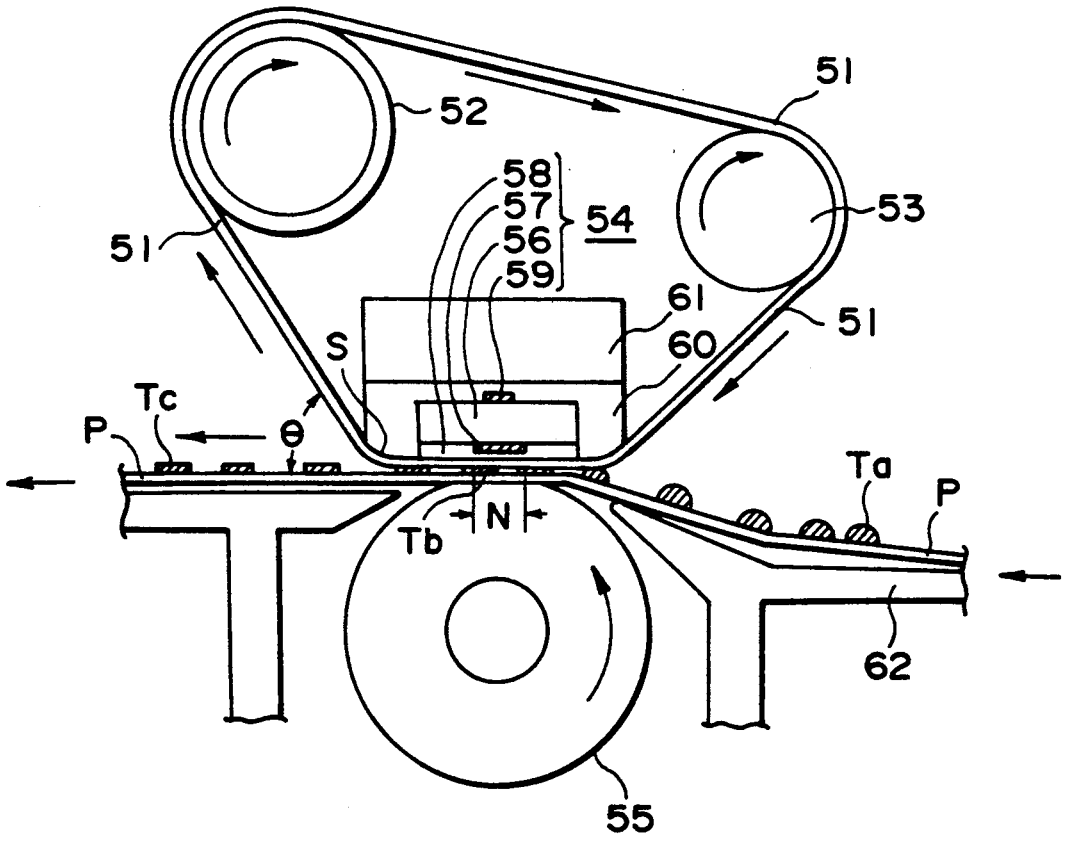
FIG. 13 is a sectional view of an example of the heating apparatus.

The structure wherein the rotatable member 10 or 10A has the functions of urging the heat resistive film 21 to the the linear heater 19 and to drive the heat resistive film 21 is usable with the tension free type apparatus as in this embodiment (at least a part of the heat resistive film 21 is tension free irrespective of whether the heat resistive film 21 is driven or not), and usable with the film tension type (as shown in FIG. 13, the circumferentially long film is always tensioned). In addition, it is usable with various types of lateral shift preventing means such as a sensor-solenoid type, rib-stopper type or end limiting type (one side or two sides). The same advantageous effects can be provided, but the present invention is most suitable to the tension free type apparatus.

In this embodiment, the recording material having passed through the nip is discharged to the outside by a discharging roller 34 and a pinch roller 38 rotatable following the discharging roller 34.

The peripheral speed of the discharging roller 34 is influential to the slip of the recording material.

The sheet conveying speed V10 by the pressing roller 10 in the nip N (the peripheral speed of the pressing roller 10), and the sheet discharging speed V34 of the discharging roller 34 (the peripheral speed of the discharging roller 34) preferably satisfy V10>V34. The difference therebetween is several %, 1–3%, for example.

If the maximum dimension F (FIG. 8) usable with the apparatus is such that F<C, where C is the width of the film 21, that portion of the sheet P bridging between the nip N and the discharging roller 34 which is in the nip N is stretched by the discharging roller 34, if V10≦34.

The heat resistive film 21 coated with the good parting property material such as PTFE is moved at the same speed as the pressing roller 10. On the other hand, the sheet P receives the pulling force in addition to the driving force by the discharging roller 34, and therefore, it is driven at the speed higher than the peripheral speed of the pressing roller 10. That is, the sheet P slips relative to the heat resistive film 21 in the nip N. This may disturb the unfixed toner image Ta (FIG. 7) or the soft or fused toner image therebetween in the nip N.

By satisfying V10>V34 described above, the sheet P is not pulled by the discharging roller 34 and receives only the feeding force by the pressing roller 10. Therefore, the disturbance to the image due to the slippage between the sheet P and the heat resistive film 21 can be avoided.

The discharging roller 34 which is a rotatable member after the nip is disposed in the fixing device 100 side, but the the fixing device 100 may be in the main apparatus using the fixing device.

The description will be made as to the interval between the film lateral end limiting flanges. When, for example, the distance C is 230 mm, the distance G between the inside surfaces of the jaws 22*a* and 23*a* of the flanges 22 and 23 is preferably larger by 1-3 mm.

The heat resistive film 21 is expanded by the heat from the linear heater 19 in the nip N to the temperature, for example, 200° C. Therefore, if the width C of the heat resistive film 21 and the flange interval G are equal to each other (C=G), and the heat resistive film 21 is limited by the flanges 22 in the normal temperature, then the width C becomes larger than the flange interval G, with operation of the apparatus. Since the heat resistive film 21 is thin, for example, 50 microns, if the heat resistive film 21 width C becomes larger than the flange interval G, the end pressure of the the heat resistive film 21 becomes so large that the end or ends are folded or yielded. In addition, the friction between the end of the heat resistive film 21 and the flanges 22 is also increased, the heat resistive film 21 feeding is influenced.

By setting the dimensions so as to satisfy C<G, even if the heat resistive film 21 is expanded by heat, the simultaneous contact of the lateral ends of the heat resistive film 21 can be avoided with the surfaces 22*a* and 23*a*.

Thus, even if the heat resistive film 21 is expanded, the pressure between the heat resistive film 21 and the flanges 22 does not increase. So, the end damage of the heat resistive film 21 can be avoided, and the driving force required for the film feeding can be avoided.

In this embodiment, the friction coefficient among various elements are set properly to prevent slip of the recording material to stably drive the film. The description will be made as to the relations among friction coefficients. The friction coefficients are defined, for description, as follows:

$\mu 1$: friction coefficient between the outer peripheral of the heat resistive film 21 and the surface of the pressing roller 10:

$\mu 2$: friction coefficient between the internal surface of the heat resistive film 21 and the surface of the linear heater 19:

$\mu 3$: friction coefficient between the surface of the linear heater 19 and the surface of the linear heater 19:

$\mu 4$: friction coefficient between the surface of the sheet P and the outer surface of the heat resistive film 21:

$\mu 5$: friction coefficient between the surface of the recording material P and the surface of the the pressing roller 10:

L1: the max. length of the sheets usable with the apparatus.

L2: length, measured along the sheet feeding passage, of the passage from an image transfer station to the fixing nip N, when the image forming apparatus has the transfer station.

The frictional coefficient satisfies $\mu 1 > \mu 2$. Preferably, the friction, coefficient (static) $\mu 1$ is not less than 1, and further preferably not more than 10; and the friction coefficient (static) $\mu 2$ is not more than 0.2.

In this type of the fixing apparatus, usually, $\mu 4 < \mu 5$, and in an usual image forming apparatus, L1>L2.

If $\mu 1 \leqq \mu 2$, the slip occurs between the heat resistive film 21 and the sheet P in the cross-sectional direction of the fixing apparatus (the heat resistive film 21 speed is lower than the pressing roller 10 peripheral speed). Then, the toner image is disturbed.

If the sheet P and the heat resistive film 21 integrally slips relative to the heat resistive film 21 (the speed of the heat resistive film 21 and the sheet P is lower than the speed of the roller 10) the toner image will be disturbed when the image is transferred onto the sheet P in the transfer station.

By setting $\mu 1 > \mu 2$, the slip between the pressing roller 10 and the heat resistive film 21 can be avoided. In addition, $\mu 1 > \mu 3$ is preferably satisfied, under the condition that C<D and D<H are satisfied, where C is the width of the heat resistive film 21, H is the length of the rotatable roller 10, and D is the length of the linear heater 19.

If this is not satisfied, the heat resistive film 21 and the pressing roller 10 slip, with the result that the heat resistive film 21 slips relative to the sheet P, and therefore, the toner image on the sheet P is disturbed.

By satisfying $\mu 1 > \mu 3$, the slip can be prevented in the width direction, particularly outside the sheet P between the pressing roller 10 and the heat resistive film 21.

As described hereinbefore, by satisfying $\mu 1 > \mu 2$ and $\mu 1 > \mu 3$, the speeds of the heat resistive film 21 and the sheet P are the same as the speed of the pressing roller 10, so that the disturbance of the toner image in the fixing and transfer operations can be avoided. By satisfying both simultaneously, the speeds of the heat resistive film 21, the pressing roller 10 and the sheet P are at all times the same. Particularly in the image transfer type apparatus, the image fixing operation is stabilized.

The description will be made as to the system for limiting lateral edges of the film. In the foregoing embodiments in conjunction with FIGS. 1-10, the lateral shifting of the film is limited by flanges 22 and 23 disposed adjacent the lateral ends of the film to prevent the lateral shift (both end limiting type). The following one end limiting type is usable. An example of such a type will be described.

Figure 11:
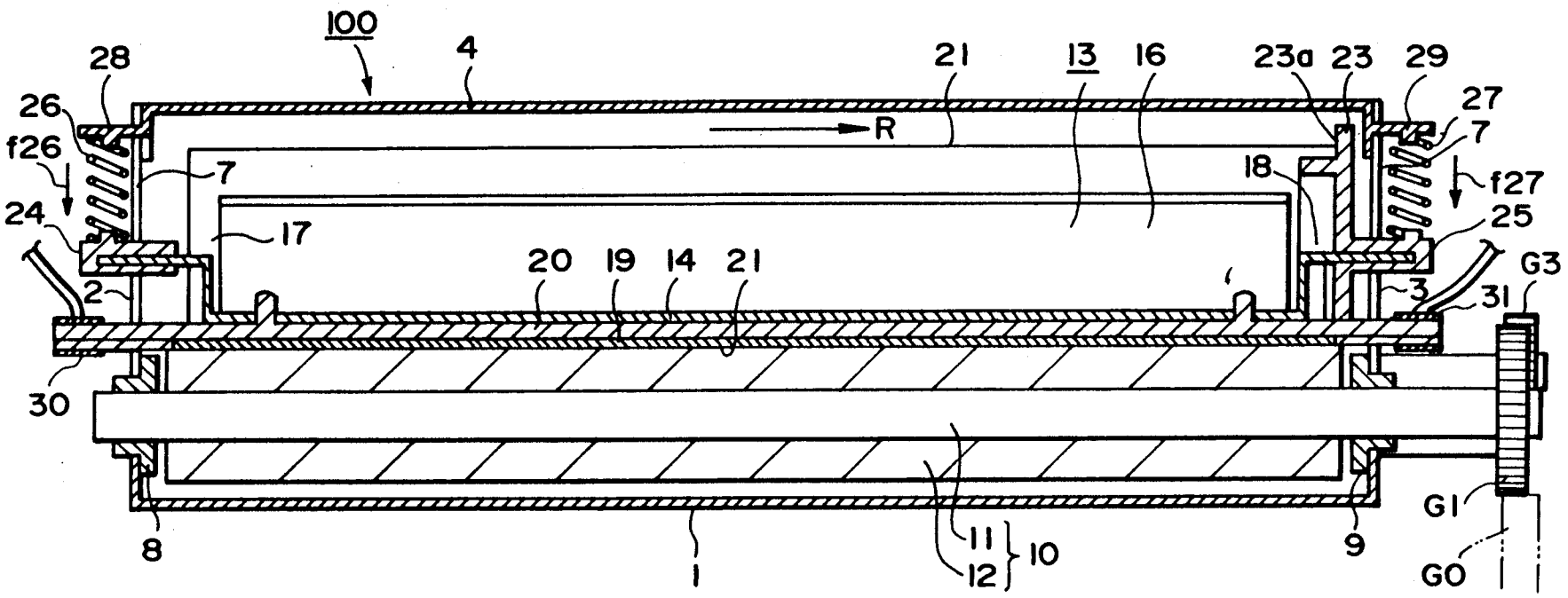
FIG. 11 is a sectional view of the image fixing apparatus according to a third embodiment of the present invention.

Referring to FIG. 11, additional embodiment will be described. In this embodiment, the pressure f27 by the driving side spring 27 (right side) is made lower than the pressure f26 by the driven side spring 26 (left side) (f27.f26). Alternatively, the configuration of the heater 19 or the pressing roller 10 is made different in the driven side than the driving side. By doing so, whenever the heat resistive film 21 is driven, the heat resistive film 21 is urged toward one predetermined lateral end. The film is limited only at this side by a flange or a rib engagement or another guiding means. More particularly, in FIG. 11, only the R side lateral end of the heat resistive film 21 is limited by the limiting member 27, by which the lateral shift of the heat resistive film 21 can be stably controlled. According to this embodiment, the image fixing operation is stabilized when the apparatus is used for an image fixing means.

Since the endless film 21 is driven by the Pressing roller for constituting the nip N, no additional driving roller is required.

This type of the apparatus is usable with the tension type wherein the film is driven with the tension thereof over the entire circumference and with tension free type as in this embodiment, although it is particularly suitable for the tension free type.

The driving member is preferably a rotatable member, but may be in the form of a belt.

The apparatus of the present invention is usable for the image fixing apparatus, and for a heating apparatus for heating an image to improve the quality of the image by increasing the glossiness.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater;

a film movable together with a recording material;

a driving rotatable member cooperative with said film to form a nip therebetween, whereby an image on the recording material being passed through the nip is heated by heat from said heater through said film;

wherein said driving member has a circumferential length which increases toward longitudinal ends thereof.

2. An apparatus according to claim 1, wherein said heater is stationary in use, and said film is slidable relative to said heater.

3. An apparatus according to claim 1, wherein said driving member is in the form of a roller having a diameter increasing toward longitudinal ends thereof.

4. An apparatus according to claim 1, wherein said film has a thickness not more than 100 microns.

5. An apparatus according to claim 4, wherein said film has a thickness not more than 40 microns.

6. An apparatus according to claim 1, wherein said film is in the form of an endless belt.

7. An apparatus according to claim 1, wherein said film comprises resin material, and said driving member has a surface layer.

8. An apparatus according to claim 3, wherein a difference between a maximum diameter and a minimum diameter is 200–400 microns.

9. An image heating apparatus, comprising:

a heater which is stationary in use;

a film in sliding contact with said heater;

a driving rotatable member cooperative with said film to form a nip therebetween, whereby an image on a recording material being passed through the nip is heated by heat from said heater through said film;

a feeding rotatable member for feeding the recording material passed through the nip;

wherein a first peripheral speed of said feeding rotatable member is smaller than a second peripheral speed of said driving member.

10. An apparatus according to claim 9, wherein said film has a thickness not more than 100 microns.

11. An apparatus according to claim 10, wherein said film has a thickness not more than 40 microns.

12. An apparatus according to claim 9, wherein said film is in the form of an endless belt.

13. An apparatus according to claim 9, wherein a difference between the two peripheral speeds is 1–3%.

14. An apparatus according to claim 9, wherein said feeding rotatable member is disposed downstream of said driving rotatable member and functions to discharge the recording material outside said apparatus.

15. An image heating apparatus, comprising:

a heater which is stationary in use;

a film in sliding contact with said heater;

a driving rotatable member cooperative with said film to form a nip therebetween, whereby an image on a recording material being passed through the nip is heated by heat from said heater through said film;

wherein a friction coefficient between said film and said driving rotatable member is larger than a friction coefficient between said film and said heater.

16. An apparatus according to claim 15, wherein said film has a thickness not more than 100 microns.

17. An apparatus according to claim 16, wherein said film has a thickness not more than 40 microns.

18. An apparatus according to claim 15, wherein said film is in the form of an endless belt.

19. An apparatus according to claim 15, wherein said film comprises resin material, and said driving member has a surface layer.

20. An apparatus according to claim 15, wherein the friction coefficient between the film and said driving rotatable member is not less than 1.

21. An apparatus according to claim 20, wherein the friction coefficient between said film and said driving rotatable member is not more than 10.

22. An apparatus according to claim 15, wherein the friction coefficient between said film and said heater is not more than 0.2.

23. An apparatus according to claim 20, wherein the friction coefficient between said film and said heater is not more than 0.2.

24. An apparatus according to claim 21, wherein the friction coefficient between said film and said heater is not more than 0.2.

25. An image heating apparatus, comprising:

a heater which is stationary in use;

a film in sliding contact with said heater;

a back-up rotatable member cooperative with said film to form a nip therebetween, whereby an image on a recording material being passed through the nip is heated by heat from said heater through said film;

wherein said nip is longer than a width of said film.

26. An apparatus according to claim 25, wherein said film has a thickness not more than 100 microns.

27. An apparatus according to claim 25, wherein said film is in the form of an endless belt.

28. An apparatus according to claim 25, wherein a friction coefficient between said heater and said back-up rotatable member is smaller than a friction coefficient between said film and said back-up rotatable member.

29. An apparatus according to claim 28, wherein a friction coefficient between the recording material and said film is smaller than a friction coefficient between the recording material and said back-up rotatable member.

* * * * *

UNITED STATES PATENT AND TRADEMARK OFFICE

CERTIFICATE OF CORRECTION

PATENT NO. : 5,148,226 Page 1 of 2

DATED : September 15, 1992

INVENTOR(S) : TAKESHI SETORIYAMA, ET AL.

It is certified that error appears in the above-identified patent and that said Letters Patent is hereby corrected as shown below:

On the Title page, item

[62] RELATED U.S. APPLICATION DATA

"Division of Ser. No. 712,573, Jun. 10, 1991, abandoned." should read --Continuation of Ser. No. 712,573, Jun. 10, 1991, abandoned.-.

COLUMN 1

Line 4, "division" should read --continuation--.

COLUMN 4

Line 54, "right the" should read --right--.

COLUMN 5

Line 12, "urges" should read --urge--.
Line 40, "Of" (both occurrences) should read --of--.
Line 42, "the 38" should read --the pinch roller 38--.
Line 43, "pinch roller" should read --the--.
Line 58, "wisely." should read --wise.--.

UNITED STATES PATENT AND TRADEMARK OFFICE

CERTIFICATE OF CORRECTION

PATENT NO. : 5,148,226 Page 2 of 2

DATED : September 15, 1992

INVENTOR(S) : TAKESHI SETORIYAMA, ET AL.

It is certified that error appears in the above-identified patent and that said Letters Patent is hereby corrected as shown below:

COLUMN 7

Line 34, "sulfon) PFA" should read --sulfon), PFA--.

COLUMN 8

Line 36, "fide" should read --fide),--.
Line 37, "therketone)" should read --therketone--.

COLUMN 10

Line 13, "sheet p" should read --sheet P--.
Line 16, "herein-before" should read --hereinbefore--.

COLUMN 11

Line 3, "which" should be deleted.
Line 5, "the" (first occurrence) should be deleted.

Signed and Sealed this

Nineteenth Day of October, 1993

Attest:

Bruce Lehman

BRUCE LEHMAN

Attesting Officer

Commissioner of Patents and Trademarks